US005083125A

United States Patent [19]

Brown et al.

[11] Patent Number: 5,083,125

[45] Date of Patent: Jan. 21, 1992

[54] EMERGENCY TRAFFIC SIGNAL PREEMPT SYSTEM

[75] Inventors: Robert H. Brown; Charles R. Liebich, both of Scottsdale; Gregory B. Page, Gilbert; Richard M. Scott, Chandler, all of Ariz.

[73] Assignee: Emergency Signal Systems, Inc., Scottsdale, Ariz.

[21] Appl. No.: 546,510

[22] Filed: Jun. 29, 1990

[51] Int. Cl.[5] ..... G08G 1/07

[52] U.S. Cl. ..... 340/906; 340/902; 340/904

[58] Field of Search ..... 340/906, 902, 903, 904; 364/424.01, 436; 455/67, 9

[56] References Cited

U.S. PATENT DOCUMENTS

| | | | |
|---|---|---|---|
| 4,016,532 | 4/1977 | Rose | 340/906 |
| 4,228,419 | 10/1980 | Anderson | 340/906 |
| 4,463,339 | 7/1984 | Frick et al. | 340/906 |
| 4,914,434 | 4/1990 | Morgan et al. | 340/906 |

*Primary Examiner*—Donnie L. Crosland

*Attorney, Agent, or Firm*—David G. Rosenbaum

[57] ABSTRACT

An emergency situation traffic signal control system, employing true radar and telemetry-based systems, which is a two-way, two frequency, full duplex transmission system. The system consists of an intersection transmitter/receiver electrically coupled to an intersection traffic signal control box and a vehicular transponder. The intersection transmitter/receiver generates an A/DCODE consisting of an access code ("ACODE") and a direction code ("DCODE"). The intersection transmitter/receiver continuously monitors the intersection by sending the A/DCODE signal in the approach directions relative to the intersection. An authorized emergency vehicle transponder approaching the intersection receives the A/DCODE, verifies the accuracy of the codes and re-transmits the DCODE, along with an optional vehicle identification code ("VID"), to the intersection transmitter/receiver for verification. If the vehicle is positively verified, control of the intersection is handed over to the vehicle by engaging valid preempt.

26 Claims, 3 Drawing Sheets

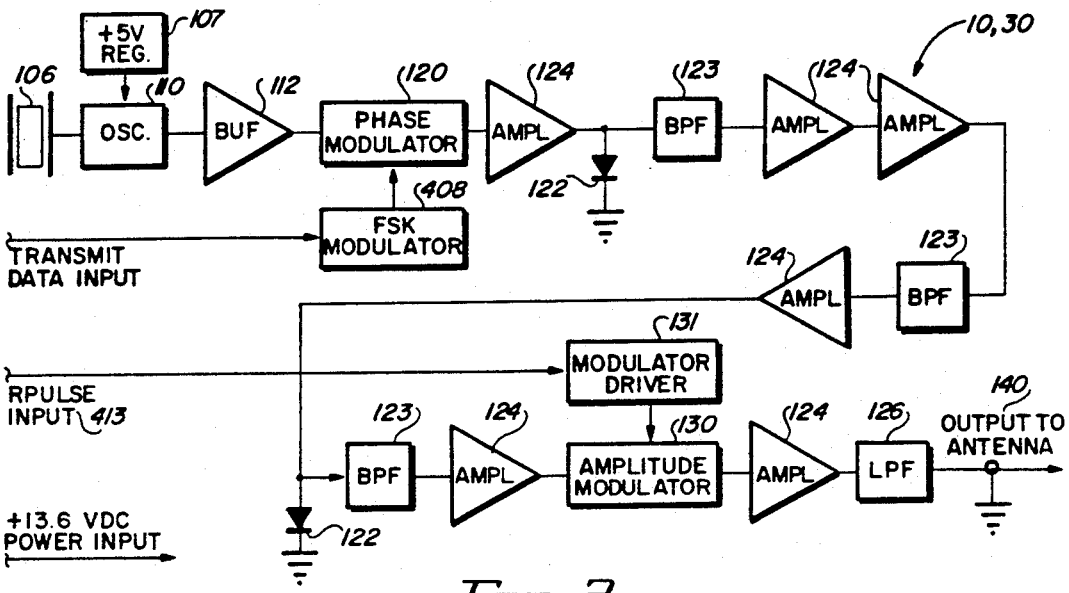
FIG. 2
FIG. 3
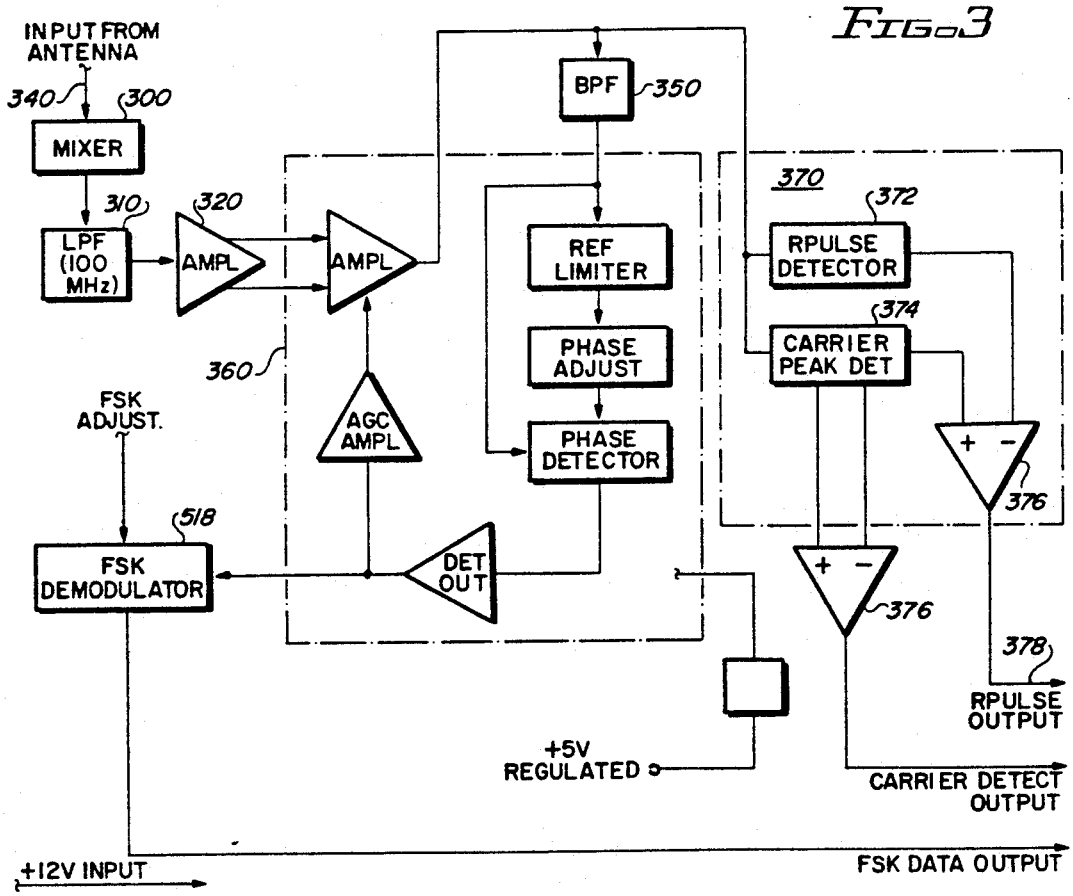

EMERGENCY TRAFFIC SIGNAL PREEMPT SYSTEM

BACKGROUND OF THE INVENTION

The present invention relates generally to a system for controlling intersection traffic signals in response to the presence of an approaching emergency vehicle. More particularly, the present invention relates to a system for providing a pre-emption signal output to an intersection traffic controller which pre-empts the existing status of the traffic lights in response to the approach of an emergency vehicle to an intersection under an emergency condition.

Under modern day traffic conditions, and particularly in high density traffic areas, there is a need for a system to modify the normal operating sequence of intersection traffic signals to permit the unimpeded and safe passage of emergency vehicles through the intersection. Not only must the emergency vehicle be free to move through the intersection in a selected direction, but the traffic flow from other, potentially interfering traffic directions, must be stopped under the appropriate traffic signal. A number of traffic control systems have been developed to accomplish this purpose, but each has, for one reason or another, fallen short of the desired result. A common approach has been to provide a transmitter associated with the emergency vehicle for transmitting an emergency signal to a receiver associated with the traffic signal controller whereby the traffic signal controller is modified by the transmitted signal to operate the traffic signals in an emergency sequence. As an example of the foregoing, see, e.g., U.S. Pat. No. 4,228,419 ("Obeck"), U.S. Pat. No. 4,017,825 ("Pinchey"), U.S. Pat. No. 4,223,295 ("Bonner"), and U.S. Pat. No. 4,573,049 ("Anderson"). Yet another type of traffic signal preempt system, described in U.S. Pat. No. Re 28,100 ("Long"), discloses a system using a light communication signal transmitted from the emergency vehicle which causes the traffic light signal controller to receive the light communication signal and control the traffic signal operation in a selected phase in response to a detected approach direction. Still another modification of a vehicle based transmission system is disclosed in U.S. Pat. No. 4,296,400 in which the vehicle is equipped with devices for automatically determining the position of the vehicle and includes a transmission receiver antenna which transmits in a direction perpendicular to the travel direction and transmits bearing information, while a second antenna is arranged to unidirectionally transmit in the direction of travel and transmits transfer commands to control the traffic light signals.

Regardless of the emergency signal transmitting system utilized, the conventional practice in all of these systems is to use a vehicle-based transmitter which activates an intersection-based receiver, linked to the traffic signal control circuitry, to control the sequence of the traffic signal at the intersection. Of the foregoing described systems, the Bonner and Anderson patents disclose emergency traffic signal control systems employing microwave signals, in which at least one directional microwave antenna is mounted at an intersection; the emergency vehicle transmits an encoded microwave signal, which is received by the intersection antenna, decoded and fed to a preempt system associated with the traffic signal controller. The Obeck patent adds a transponder to the intersection receiver which confirms receipt of the transmitted signal to the vehicle.

Those skilled in the art will understand and appreciate that each of the foregoing conventional emergency vehicle traffic signal control systems requires the emergency vehicle to provide the first affirmative signal to which the intersection controller is responsive.

SUMMARY OF THE INVENTION

In accordance with the present invention there is provided a true radar and telemetry-based emergency vehicle traffic signal control system, which is a two-way, two frequency, full duplex transmission system. The system of the present invention consists, generally, of an intersection transmitter/receiver electrically coupled to an intersection traffic signal control box and a vehicular transponder. The intersection transmitter/receiver generates an A/DCODE consisting of an access code ("ACODE") and a direction code ("DCODE"). The ACODE is fixed and used by the system for security. The DCODE identifies a particular intersection direction and is variable and may be preselected by the traffic engineer to facilitate street lay-out. The intersection transmitter/receiver continuously monitors the intersection by sending the A/DCODE signal in the approach directions relative to the intersection. An authorized emergency vehicle transponder approaching the intersection receives the A/DCODE, verifies the accuracy of the codes and re-transmits the DCODE, and optionally a vehicle identification code ("VID"), to the intersection transmitter/receiver for verification. If the vehicle is positively verified, control of the intersection is handed over to the vehicle by engaging a valid pre-empt signal which is output to the traffic light controller. Many modern traffic light controllers are pre-equipped with electrical hook-ups and software which receive the pre-empt signal and activate the traffic light pre-emption routine within the traffic light controller.

The transmission of the A/DCODE from the intersection occurs in a forward link transmission, and the transmission of the DCODE, along with an optional VID code, from the vehicle occurs in a return link transmission. Each of the forward link and return link transmission paths are unique and simultaneous, and share the same intermediate frequency spectrum. A single antenna is used at each end of the path, and both receive and transmit functions have independent orthogonally spaced feeds, which share a common launch mechanism.

BRIEF DESCRIPTION OF THE DRAWINGS

FIG. 2 is a block diagram of a transmitter portion of an intersection transmitter/receiver and a vehicular receiver/transmitter as employed in the present invention.

FIG. 3 is a block diagram of a receiver portion of an intersection transmitter/receiver and a vehicular receiver/transmitter employed in the present invention.

DETAILED DESCRIPTION OF THE PREFERRED EMBODIMENT

Figure 1:
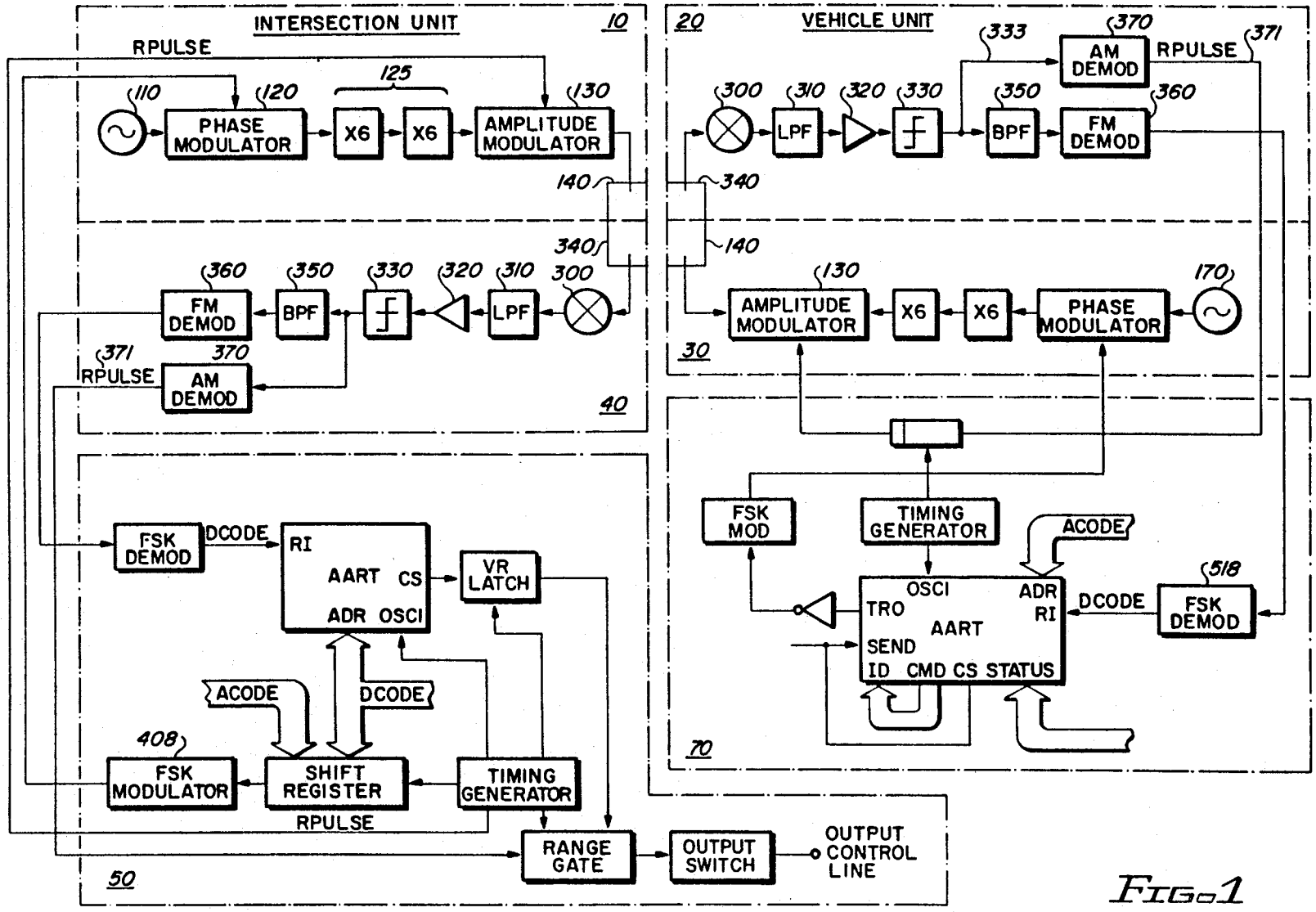
FIG. 1 is a block diagram of the emergency vehicle traffic control system according to the present invention.

The emergency vehicle traffic signal control system is illustrated generally with reference to FIG. 1. As generally shown in FIG. 1, the system of the present invention consists generally of an intersection transmitter 10, a vehicular receiver 20, a vehicular transmitter 30, an intersection receiver 40, an intersection signal generator/controller 50 and a vehicular receiver/transmitter controller 70.

As illustrated in FIGS. 1-3, the intersection transmitter 10 and the vehicular transmitter 30 are identical, as are the vehicular receiver 20 and the intersection receiver 40. Each of the intersection and vehicular units have reciprocal processing of the signals on each of the forward signal link and the return signal link.

For ease of understanding, the system of the present invention will be described with reference to the signal generation and processing as it is generated in the intersection generator/controller 50, linked to the intersection transmitter 10, sent to the vehicular receiver 20 in the forward link, processed in the vehicular receiver/-transmitter controller 70 and returned, in a return link, to the vehicular transmitter 30 which sends the return signals to the intersection receiver 40 for processing by the intersection generator/controller 50 to authorize a valid pre-empt of the traffic signal controller.

Figure 4:
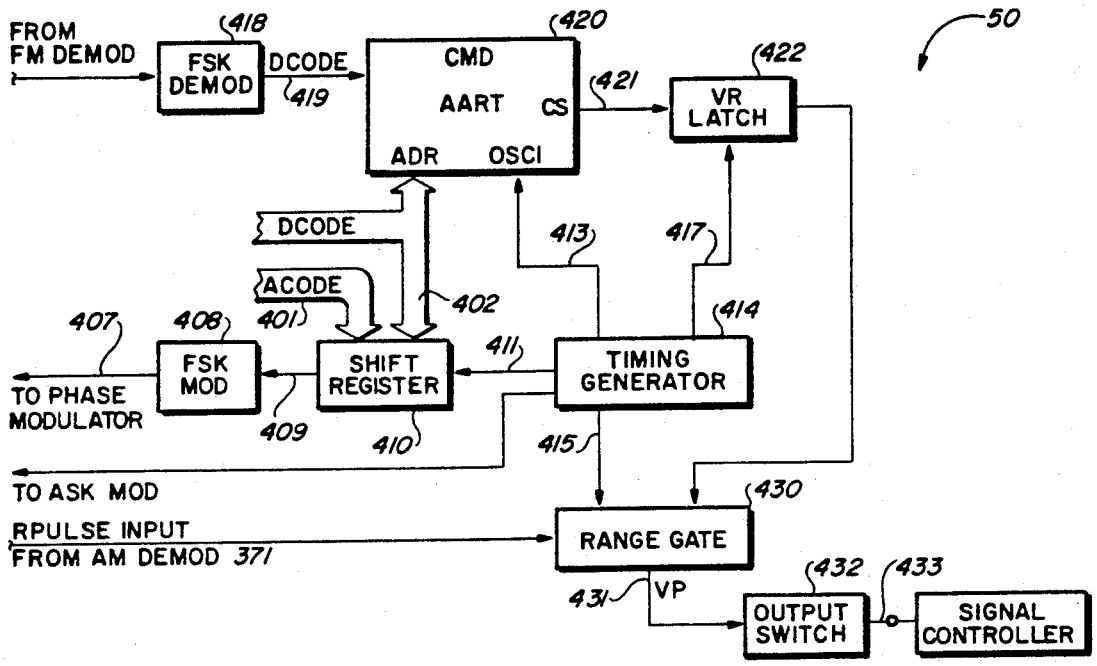
FIG. 4 is a block diagram of an intersection signal generator/controller in accordance with the present invention.

As illustrated with reference to FIG. 1 and, more particularly with reference to FIG. 4, the intersection signal generator/controller 50 consists generally of a shift register 410 which generates a two component signal ("A/DCODE") consisting of an access code ("ACODE") 401 and a direction code ("DCODE") 402. The ACODE 401 is a fixed code which is used by the system for security, while the DCODE 402 is variable and is preselected to identify a particular intersection direction from another.

A timing generator 414 is connected to the shift register 410 via connector 411. Timing generator 414 generates two signals; a DATA CLOCK and a DATA BURST signal. The DATA CLOCK signal sets the data transmission baud rate and the DATA BURST signal directs the shift register 410 to load the A/D-CODE when high and transmit the A/DCODE when low. It has been found that by having the DATA CLOCK set the data transmission baud rate to 610 bps, and the DATA BURST rate set at 19 Hz, the A/D-CODE is constantly being reloaded in the shift register 414 and the possibility of a data corrupting bit flip is minimized to no more than one burst period. The timing generator 414 also produces a short ranging pulse signal, the RPULSE 413, which is transmitted while DATA BURST is high. The RPULSE is conducted to the amplitude modulator 130, on the transmitter side of the intersection transmitter/receiver 30, and applied to the RF signal by means of blanking the transmitted RF signal for the duration of the RPULSE. The RPULSE is used in the ranging subsystem to determine when the vehicle unit is within range to exercise control over the intersection and trigger generation of the pre-empt signal.

After the A/DCODE is transmitted by the shift register 410, it is conducted to a FSK modulator 408 where the digital data is converted to two discrete frequencies for transmission. These frequencies are referred to as forward tones. The forward tones are conducted to a phase modulator 120 in the transmission circuitry of the intersection transmitter/receiver (see, e.g., FIGS. 1 and 2), where they are impressed upon a transmit RF signal.

The generation and transmission of the RF signal, from the transmit side of the intersection transmitter/-receiver 10, is generally illustrated in FIG. 1. An oscillator 110 generates a RF signal which is conducted to the phase modulator 120. As previously set forth above, the phase modulator 120 also receives the A/DCODE from the FSK modulator and impresses the A/DCODE upon the generated RF signal. After being processed through RF signal processing circuitry 125, the processed RF signal is conducted to an amplitude modulator 130. Amplitude modulator 130 also receives the RPULSE signal from timing generator 414 and impresses the RPULSE signal on the RF signal prior to transmission from antenna 140.

By way of example only, and not intended to be limiting in scope, RF signal processing circuitry 125, is more particularly illustrated in FIG. 2 according to the best mode contemplated by the present invention. FIG. 2 illustrates a signal path for generating RF energy beginning with an oscillator 110 which is controlled by a crystal 106 and powered by voltage regulator 107. The oscillator 110 feeds the generated RF energy into a buffer 112, which isolates the oscillator from the phase modulator 120. Phase modulator 120 receives the A/D-CODE forward tones from FSK modulator 408 and places them into the RF signal. The signal is passed through an amplifier 124 to increase signal power and its frequency multiplied times six by multiplier 122. The RF signal is further processed by additional filters 123, amplifiers 124 and again frequency multiplied times six by a second multiplier 122. It has been found that frequency multiplication greater than a factor of six in a single process step reduces reliability of the signal. Therefore, it is desirable, according to the best mode of the invention to split up the signal processing into smaller process units and employ the additional amplifiers 124, filters 123 and multiplier 122.

After the serial processing of the amplified and multiplied RF signal, the signal is input to an amplitude modulator 130, which is driven by the RPULSE input 413 through a modulator driver 131. Amplitude modulation blanks the RF signal output power for the period of the RPULSE input 413. According to the best mode of the invention, it has been found that the RPULSE duration should be about 50 ns. Output from the amplitude modulator is passed through another amplifier 124 and filtered through a low pass filter 126, e.g., 4000 Mhz, to filter high order spurious frequency radiation. The RF signal output 127 is then fed to the antenna 140.

Crystal 106 is selected to have a frequency of about 92-94 Mhz. This frequency is desirable to acquire frequency stability, and has been found to be the highest frequency compatible with frequency multiplication ratios to achieve design and cost economy.

After transmission from antenna 140, the A/DCODE signal is received by the vehicle receiver side of the vehicle receiver/transmitter 30. As illustrated generally, with reference to FIGS. 1, the receiver side of the vehicle receiver/transmitter 30 receives the RF signal transmitted from antenna 140, demodulates the A/D-CODE signal by an FM demodulator 360 to recover the forward tones and by an AM demodulator 370 to recover the RPULSE.

With more particular reference to FIG. 3, and by way of example only, and not intended to be limiting in scope, the receiver 30 is more particularly illustrated in accordance with the best mode contemplated by the present invention. Input from antenna 340 is fed to a mixer 300, which obtains its local oscillator ("LO") drive from the transmitter in its respective unit. The frequency scheme is represented by the following equation:

$$F_{vlo}-F_{ti}=IF=F_{ilo}-F_{tv}$$

wherein:

IF = Intermediate frequency;

$F_{vlo}$ = vehicle receiver LO (frequency from vehicle transmitter);

$F_{ti}$ = transmitted frequency from intersection transmitter;

$F_{ilo}$ = intersection receiver LO (frequency from intersection transmitter);

$F_{tv}$ = transmitted frequency from vehicle transmitter.

The mixed RF signal is passed through a low pass filter 310, e.g., 100 MHz, which limits the IF bandwidth to the minimum required by the RPULSE. The filtered RF signal is fed to amplifier 320. After amplification, the amplified RF signal is split to feed an FM demodulator 360, which reproduces the FSK forward tones, and an AM demodulator 370. The FSK forward tones are demodulated by the FM demodulator 360. The AM demodulator 370 constantly sees a carrier, except when the RPULSE is present. When the RPULSE is present, the AM demodulator 370 produces an output RPULSE, which is delayed and sent to the transmitter in the case of the vehicle unit or to the range gate in the case of an intersection unit. As illustrated in FIG. 3, the AM demodulator 370 splits the incoming signal and feeds an RPULSE detector 372 and a carrier detector 374. The RPULSE detector 372 and the carrier detector 374 are each connected to a comparator 376, which directs the generation of the RPULSE output 378 when the RPULSE is detected. The carrier detector 374 is also connected to a second comparator 376, to provide a carrier detect circuit and ensure that an RPULSE is not validated without a proper carrier. In accordance with the best mode contemplated by the invention, the AM demodulator 370 is auto-thresholding to stabilize the circuit over varying signal levels in order to accurately produce detection.

Figure 5:
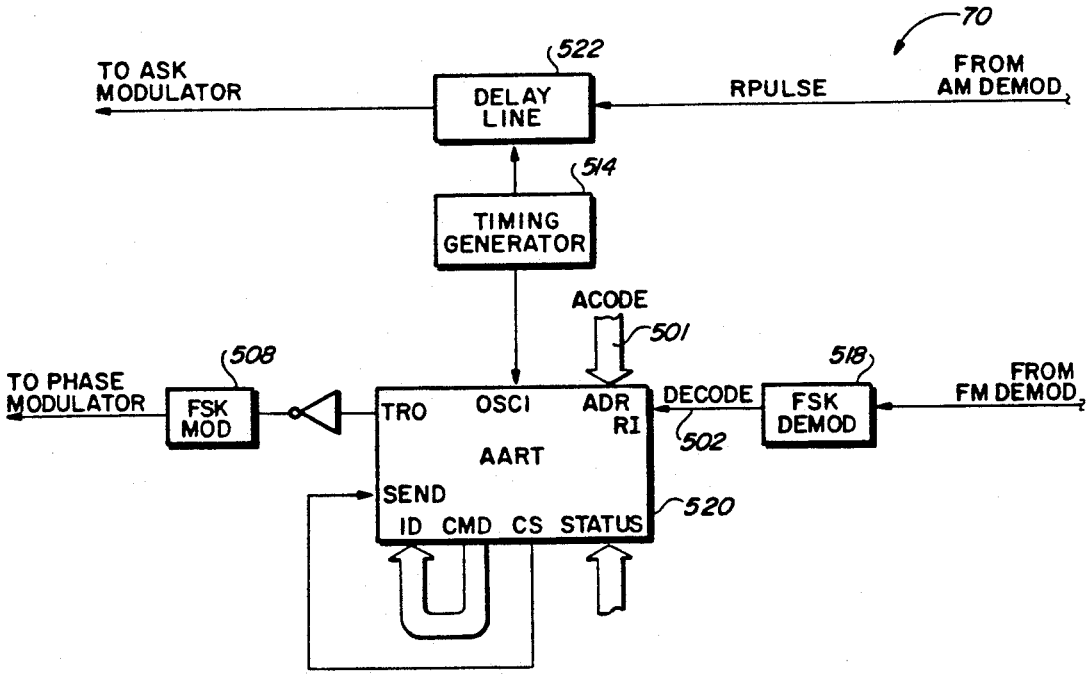
FIG. 5 is a block diagram of a vehicular receiver/transmitter control in accordance with the present invention.

A vehicle receiver/transmitter controller 70 is more particularly illustrated with reference to FIG. 5. The output from the FM demodulator 360 in the vehicle receiver/transmitter 30 is conducted to the vehicle receiver/transmitter 70, where the A/DCODE is recovered from the forward tones by an FSK demodulator 518. The A/DCODE is applied to an addressable asynchronous receiver/transmitter ("AART") 520 which checks that the proper ACODE is received. If the ACODE is correct the AART 520 will retransmit the DCODE, and other optional signals such as a vehicle ID code ("VID"), date, time or other desired identifier signal, to a FSK modulator 508 which converts the DCODE, an the optionally supplied VID code, to return tones, which are different from the forward tones to prevent data collisions. The return tones are conducted to the phase modulator 120 on the transmitter side 10 of the vehicle receiver/transmitter, for transmission of the return tones to the intersection receiver.

The RPULSE conducted from the AM demodulator 370 is delayed in the vehicle receiver/transmitter controller 70, by timing generator 514 and delay line 522 on the transmitter side of the vehicle receiver/transmitter. The delay is accomplished by using a digitally timed shift register and is applied to the RF signal by blanking the transmitted signal for the duration of the RPULSE by the amplitude modulator 130, as previously explained.

The signal received by the intersection receiver 40 is demodulated in the same manner as in the vehicle receiver 20. As illustrated in FIG. 4, the DCODE/VID 419 is applied to an AART 420, which compares the received DCODE to that of the initially transmitted A/DCODE. If the DCODE matches, the AART will recover the optional VID and set a valid return ("VR") latch 422.

The RPULSE 371 received from the AM demodulator 370 of the intersection receiver 40 is conducted to the range gate 430. The range gate opens a window corresponding to a maximum pre-selected distance in which a vehicle can control the intersection. If the RPULSE 371 arrives during the time that the range gate is open, and the VR latch 422 is set, then the range gate 430 will output a valid pre-empt ("VP") pulse 431 to an output switch 432 to activate a valid pre-empt of the traffic lights by the traffic signal controller. The output switch 432 also delays the turning off the pre-empt output for a sufficient period of time to allow the emergency vehicle time to clear the intersection.

A single antenna is used at each end of the path, and both receive and transmit functions have independent orthogonally spaced feeds, which share a common launch mechanism. It is desirable to provide a physically small antenna to reduce bulk and wind loading, especially for the vehicle. The antenna must have enough gain and the proper E and H plane beam-widths to satisfy the directional properties of the electronics. According to the best mode known to the inventors at present, an orthogonally-fed circular wave guide, also known as a polar-diplexer or polarplexer, satisfies these requirements. When employed with the electronics of the present system, circular wave guides provide a considerable advantage in that they provide differential vertical and horizontal beamwidths. In the present system design, the antenna beamwidth should be narrow in the physical horizontal plane, in order to discriminate one intersection direction from another, and it should be broad in the physical vertical plane, in order to "see" the vehicle antenna into the intersection and avoid loss of signal. In accordance with the best mode of the invention, the electrical horizontally polarized antenna element has a narrow beamwidth of 26° and the electrical vertically polarized element is broader at 47°. Those skilled in the art will, however, recognize and appreciate there is considerable latitude in antenna design, or dimensional selection of antenna design, which will change the electrical properties.

Optionally, a visual warning system, such as that disclosed by the Pichey patent or a strobe, may be integrated into the system to provide a visual signal to approaching emergency vehicles that a valid pre-empt has occurred or that another emergency vehicle has assumed control over the intersection.

The foregoing described preferred embodiment of the invention contemplates that the existing traffic signal controller installed at the intersection has electrical hook-ups and software programming to receive a pre-empt signal and control the traffic signals according to a preselected preemption routine selected by the traffic engineer. Such traffic controllers are known in the art. Where a city has older traffic controllers, a pre-empt controller may be added to receive the pre-empt signal and direct intersection traffic signals through the selected preemption routine. Examples of such traffic signal pre-empt controllers are found in the Bonner and Long patents, previously cited.

It will be apparent to those skilled in the art, that the foregoing detailed description of the preferred embodiment of the present invention is representative of a type of system for controlling traffic signals by an emergency vehicle within the scope and spirit of the present invention. Further, those skilled in art will recognize that various changes in materials, specific components or interrelationship between components may be altered or changed and remain within the scope and spirit of the present invention.

What is claimed is:

1. An emergency traffic signal control system, comprising:

means for generating at least an access code (ACODE), a direction code (DCODE) and a ranging signal (RPULSE);

an intersection based transmitter/receiver, electrically coupled to said means for generating said codes, said intersection based transmitter/receiver generates an RF signal and impresses said generated codes upon said RF signal and directionally transmits said RF signal as forward tones;

a vehicle based receiver/transmitter which receives said transmitted forward tones;

signal processing means, electrically coupled to said vehicle based receiver/transmitter, for processing said received forward tones and returning said received forward tones as return tones, to said vehicle based receiver/transmitter for return transmission to said intersection transmitter/receiver; and means for validating said return tones and controlling the traffic signals in response to validated return tones and to said ranging signal, said means being electrically coupled to said intersection transmitter/receiver and to said means for generating an RF signal.

2. The emergency traffic signal control system according to claim 1, wherein said intersection transmitter/receiver and said vehicle based receiver/transmitter each further comprise a transmitter, said transmitter comprising an oscillator, a phase modulator and an amplitude modulator and a receiver, said receiver comprising an AM demodulator and an FM demodulator.

3. The emergency traffic signal control system according to claim 2, wherein phase modulator receives said ACODE and said DCODE and impresses said ACODE and said DCODE onto said RF signal from said means for generating said at least an ACODE, DCODE and RPULSE.

4. The emergency traffic signal control system according to claim 2, wherein said amplitude modulator receives said RPULSE and impresses said RPULSE onto said RF signal prior to transmission of said RF signal from said transmitter.

5. The emergency traffic signal control system according to claim 2, wherein said AM demodulator separates said RPULSE from said forward tones.

6. The emergency traffic signal control system according to claim 2, wherein said FM demodulator separates said ACODE and said DCODE from said forward tones.

7. The emergency traffic signal control system according to claim 1, wherein said signal processing means further comprises means for separating said ACODE and said DCODE from said forward tones, an addressable asynchronous receiver/transmitter, a timing generator and means for encoding signals received from said addressable asynchronous receiver/transmitter and generating said return tones.

8. The emergency traffic signal control system according to claim 7, wherein said means for separating said ACODE and said DCODE from said forward tones further comprises an FSK demodulator, said FSK demodulator receives input from vehicle based receiver/transmitter and recovers said ACODE and said DCODE from said forward tones.

9. The emergency traffic signal control system according to claim 8, wherein said addressable asynchronous receiver/transmitter receives said recovered ACODE and said DCODE from said FSK demodulator, verifies that the proper ACODE was received, and upon said verification transmits the DCODE with said vehicle identification code (VID) to said FSK modulator.

10. The emergency traffic signal control system according to claim 9, wherein said means for encoding signals received from said addressable asynchronous receiver/transmitter further comprises an FSK modulator, said FSK modulator receives said DCODE and said vehicle identification code and converts said codes to return tones, said return tones being different and distinct from said forward tones.

11. The emergency traffic signal control system according to claim 10, wherein said timing generator delays return transmission of said RPULSE by said vehicle based receiver/transmitter.

12. The emergency traffic signal control system according to claim 7, wherein said means for validating said return tones further comprises means for recovering said DCODE from said return tones, an addressable asynchronous receiver/transmitter, a valid return latch which is set in response to said addressable asynchronous receiver/transmitter matching said recovered DCODE with said transmitted DCODE in said forward tones a range gate electrically coupled to said AM demodulator of said intersection receiver and to said valid return latch and an output switch activates a valid pre-empt of the traffic signals.

13. The emergency traffic signal control system according to claim 12, wherein said means for recovering said DCODE from said return tones further comprises an FSK demodulator.

14. The emergency traffic signal control system according to claim 12, wherein said range gate is open in response to a maximum pre-selected distance in which a vehicle can control the intersection.

15. The emergency traffic signal control system according to claim 14, wherein said output switch is activated when the range gate is open when the RPULSE arrives at the range gate and the valid return latch is set.

16. An emergency control system for traffic signals at intersections and a main traffic controller associated with the traffic signals, comprising:

means for generating at least a digital access code (ACODE), a digital direction code (DCODE) and a digital ranging signal (RPULSE);

an intersection based transmitter/receiver, comprising a transmitter, said transmitter further comprising an oscillator, a phase modulator and an amplitude modulator, and a receiver, said receiver further comprising an AM demodulator and an FM demodulator, said transmitter/receiver being electrically coupled to said means for generating said codes, wherein said intersection based transmitter/receiver generates an RF signal, said phase modulator receives said ACODE and said DCODE from said means for generating said codes and impresses said ACODE and said DCODE onto said RF signal, and said amplitude modulator receives said RPULSE from said means for generating said codes and impresses said RPULSE onto said RF signal prior to transmission of said impressed RF signal from said transmitter as forward tones;

a vehicle based receiver/transmitter, comprising a transmitter, said transmitter further comprising an oscillator, a phase modulator and an amplitude modulator, and a receiver, said receiver further comprising an AM demodulator and an FM demodulator, said receiver/transmitter receiving said transmitted forward tones;

signal processing means, electrically coupled to said vehicle based receiver/transmitter, for processing said received forward tones and returning said received DCODE to said vehicle based receiver/transmitter for return transmission to said intersection transmitter/receiver; and means for validating said return tones and controlling the traffic signals in response to validated return tones and to said ranging signal, said means being electrically coupled to said intersection transmitter/receiver and to said means for generating an RF signal and further comprising means for recovering said DCODE from said return tones, an addressable asynchronous receiver/transmitter, a valid return latch, which is set in response to said addressable asynchronous receiver/transmitter matching said recovered DCODE with said transmitted DCODE in said forward tones, a range gate electrically coupled to said AM demodulator of said intersection receiver and to said valid return latch and an output switch activates a valid preempt of the traffic signals.

17. The emergency traffic signal control system according to claim 16, wherein said AM demodulator separates said RPULSE from said forward tones.

18. The emergency traffic signal control system according to claim 16, wherein said FM demodulator separates said ACODE and said DCODE from said forward tones.

19. The emergency traffic signal control system according to claim 16, wherein said signal processing means further comprises an FSK demodulator, an addressable asynchronous receiver/transmitter, a timing generator and an FSK modulator.

20. The emergency traffic signal control system according to claim 19, wherein said FSK demodulator receives input from said intersection based receiver/transmitter and recovers said ACODE and said DCODE from said forward tones.

21. The emergency traffic signal control system according to claim 20, wherein said addressable asynchronous receiver/transmitter receives said recovered ACODE and said DCODE from said FSK demodulator, verifies that the proper ACODE was received, and upon said verification transmits the DCODE with said vehicle identification code (VID) to said FSK modulator.

22. The emergency traffic signal control system according to claim 21, wherein said FSK modulator receives said DCODE and said vehicle identification code and converts said codes to return tones, said return tones being different and distinct from said forward tones.

23. The emergency traffic signal control system according to claim 21, wherein said timing generator delays return transmission of said RPULSE by said vehicle based receiver/transmitter.

24. The emergency traffic signal control system according to claim 16, wherein said means for recovering said DCODE from said return tones further comprises an FSK demodulator.

25. The emergency traffic signal control system according to claim 16, wherein said range gate is open in response to a maximum pre-selected distance in which a vehicle can control the intersection.

26. The emergency traffic signal control system according to claim 25, wherein said output switch is activated when the range gate is open, the RPULSE arrives at the range gate and the valid range latch is set.

* * * * *